US012656005B2

(12) United States Patent
Ferkey et al.

(10) Patent No.: US 12,656,005 B2
(45) Date of Patent: Jun. 16, 2026

(54) SYSTEM AND METHOD FOR COORDINATED SINGLE SETPOINT HUMIDITY CONTROL

(71) Applicant: Research Products Corporation, Madison, WI (US)

(72) Inventors: Wade Ferkey, Madison, WI (US); Tom Friederick, Madison, WI (US); Chip Seidel, Madison, WI (US); Sean McCarthy, Madison, WI (US); Nicholas Balazs, Madison, WI (US)

(73) Assignee: Research Products Corporation, Madison, WI (US)

( * ) Notice: Subject to any disclaimer, the term of this patent is extended or adjusted under 35 U.S.C. 154(b) by 246 days.

(21) Appl. No.: 18/480,300

(22) Filed: Oct. 3, 2023

(65) Prior Publication Data

US 2024/0117981 A1 Apr. 11, 2024

Related U.S. Application Data

(60) Provisional application No. 63/414,134, filed on Oct. 7, 2022.

(51) Int. Cl.
*F24F 11/00* (2018.01)
*F24F 3/14* (2006.01)
(Continued)

(52) U.S. Cl.
CPC ..... *F24F 11/0008* (2013.01); *F24F 3/14* (2013.01); *F24F 11/61* (2018.01); *F24F 11/64* (2018.01);
(Continued)

(58) Field of Classification Search
None
See application file for complete search history.

(56) References Cited

U.S. PATENT DOCUMENTS 4,841,738 A 6/1989 Katsuki et al.
7,770,405 B1 * 8/2010 Dillon ..... F25B 13/00 62/93

(Continued)

FOREIGN PATENT DOCUMENTS

EP 1 258 688 11/2002
WO WO-2009/035077 3/2009

*Primary Examiner* — Jerry-Daryl Fletcher
*Assistant Examiner* — Daniel C Comings
(74) *Attorney, Agent, or Firm* — Foley & Lardner LLP

(57) ABSTRACT

A humidity control system and method for controlling the humidity of ambient air is disclosed. The system includes a humidification and dehumidification systems to increase and/or decrease the humidity level of an indoor space and a sensor to sense ambient conditions of the space. The system further includes a controller that receives a humidity setpoint for the indoor space, determines the humidity level associated with the indoor space, compares the determined humidity level to the humidity setpoint, and causes activation of one of a humidification system or a dehumidification system. In response to causing the activation of one of the humidification or dehumidification system, the controller initiates a lockout condition during which the other of the one of the humidification or dehumidification system is prevented from activation. The controller also monitors for an override condition and enables activation of the other of the humidification system or the dehumidification system accordingly.

25 Claims, 3 Drawing Sheets

(51) Int. Cl.

| | |
|---|---|
| ***F24F 11/61*** | (2018.01) |
| ***F24F 11/64*** | (2018.01) |
| ***F24F 11/65*** | (2018.01) |
| *F24F 110/10* | (2018.01) |
| *F24F 110/20* | (2018.01) |

(52) U.S. Cl.
CPC ..... *F24F 11/65* (2018.01); *F24F 2110/10* (2018.01); *F24F 2110/20* (2018.01); *F25B 2600/23* (2013.01)

(56) References Cited

U.S. PATENT DOCUMENTS

| | | | | |
|---|---|---|---|---|
| 9,157,646 | B2 | 10/2015 | Anderson et al. | |
| 9,551,501 | B2 | 1/2017 | Schnell et al. | |
| 9,816,719 | B2 | 11/2017 | Bergman et al. | |
| 10,496,057 | B2 | 12/2019 | Hrejsa | |
| 2012/0168119 | A1* | 7/2012 | Dunnavant ..... | H05K 7/20745 165/59 |
| 2014/0148341 | A1* | 5/2014 | Chan ..... | G05B 19/4142 504/159 |
| 2018/0031266 | A1* | 2/2018 | Atchison ..... | F24F 11/30 |
| 2021/0381705 | A1* | 12/2021 | Cawley ..... | B01D 46/46 |

* cited by examiner

SYSTEM AND METHOD FOR COORDINATED SINGLE SETPOINT HUMIDITY CONTROL

CROSS-REFERENCE TO RELATED APPLICATIONS

This application claims the benefit of and priority to U.S. Provisional Patent Application No. 63/414,134 filed Oct. 7, 2022, the entire contents of which are incorporated herein by reference.

BACKGROUND

The present disclosure relates generally to systems for controlling humidity of ambient air. More specifically, the disclosure relates to coordinated control of humidification and dehumidification components of such a system in accordance with a single setpoint.

Humidifying systems are designed to provide humidified air in response to a call for humidity (e.g., from a humidistat, thermostat, portable user device, etc.). In contrast, dehumidifying systems are designed to reduce the humidity of ambient air in response to a call for dehumidification. Typically, the call for humidity is responsive to a sensed humidity level falling below a second setpoint humidity level while the call of dehumidification is responsive to a sensed humidity level exceeding a second setpoint humidity level. Traditional systems that combine humidifying systems with dehumidifying systems generally require different humidity setpoints for control of a humidifying system and control of the dehumidifying system. These different humidity setpoints must have a sufficient difference in humidity level to prevent essentially non-stop operation of at least one of the humidifying or dehumidifying systems. However, due to this difference in setpoints, such combined systems offer imprecise humidity control and a more complicated control interface that requires the setting of multiple humidity setpoints.

Accordingly, it would be advantageous to provide a more precise system for controlling humidity that allows for coordinated control of a humidifying system and a dehumidifying system based on a single setpoint humidity level.

SUMMARY

According to one aspect of the present disclosure, a system for controlling humidity of an indoor space includes a humidification system that increases the humidity level of the indoor space, a dehumidification system that decreases the humidity level of the indoor space, and a sensor that senses ambient conditions of the indoor space. The system further includes a controller operably coupled to the humidification system, the dehumidification system, and sensor and that receives a humidity setpoint for the indoor space, determines a humidity parameter associated with the indoor space, compares the determined humidity parameter to the humidity setpoint, and in response to a result of the comparing, causes activation of one of a humidification system or a dehumidification system. In response to causing the activation of one of the humidification system or the dehumidification system, the controller initiates a lockout condition during which the other of the one of the humidification system or the dehumidification system is prevented from being activated. The controller also monitors conditions associated with the indoor space to determine existence of an override condition and, in response to at least one of the override condition or expiration of the lockout condition, enables activation of the other of the one of the humidification system or the dehumidification system.

According to an embodiment of the system, the humidity parameter comprises a measured or calculated humidity level and the lockout condition comprises a predetermined period of time during which the other of the one of the humidification system or the dehumidification system is prevented from being activated. According to another embodiment, the humidity parameter comprises a sensed humidity level, and, to monitor the conditions associated with the indoor space to determine existence of the override condition, the controller determines a difference between the sensed humidity level and the humidity setpoint and determines the existence of the override condition in response to the difference between the sensed humidity level and the humidity setpoint exceeds an override threshold difference. The controller is further configured to, in response to determining the existence of the override condition, cause activation of the other of the one of the humidification system or the dehumidification system.

According to still further embodiments of the system, the controller receives a sensed humidity level associated with the indoor space and receives a sensed temperature associated with the indoor space. To determine the humidity parameter associated with the indoor space, the controller calculates a vapor pressure deficit associated with the indoor space based on the sensed humidity level and the sensed temperature.

To monitor the conditions associated with the indoor space to determine existence of the override condition, the controller may also implement a schedule-based override condition. Implementing the schedule-based override condition includes comparing a present time to a time-based schedule, wherein the time-based schedule comprises a plurality of time periods having respective associated humidity setpoints, determining a next time period of the time-based schedule based on the present time, determining that the humidity setpoint associated with the next time period necessitates activation of the other of the one of the humidification system or the dehumidification system, and in response to the present time being within a threshold time of the next time period and in response to the determination that the humidity setpoint associated with the next time period necessitates activation of the other of the one of the humidification system or the dehumidification system, causing activation of the other of the one of the humidification system or the dehumidification system prior to the expiration of the lockout condition. Determining that the humidity setpoint associated with the next time period necessitates activation of the other of the one of the humidification system or the dehumidification system may include monitoring the humidity parameter associated with the indoor space during the lockout condition, determining a difference between the monitored humidity parameter and the humidity setpoint associated with the next time period, and determining that the humidity setpoint associated with the next time period necessitates activation of the other of the one of the humidification system or the dehumidification system in response to the difference between the monitored humidity parameter and the humidity setpoint associated with the next time period satisfying a threshold difference. In addition, the controller initiates the lockout condition upon expiration of a humidification call or a dehumidification call associated with the activation of one of the humidification system or the dehumidification system in various embodiments.

In another aspect of the present disclosure, a method for controlling humidity of an indoor space includes receiving, by a controller, a humidity setpoint for the indoor space, determining a humidity parameter associated with the indoor space, comparing the determined humidity parameter to the humidity setpoint, and, in response to a result of the comparing, causing activation of one of a humidification system or a dehumidification system. The method further includes, in response to causing the activation of one of the humidification system or the dehumidification system, initiating a lockout condition during which the other of the one of the humidification system or the dehumidification system is prevented from being activated, monitoring conditions associated with the indoor space to determine existence of an override condition, and, in response to at least one of the override condition or expiration of the lockout condition, enabling activation of the other of the one of the humidification system or the dehumidification system.

The foregoing summary is illustrative only and is not intended to be in any way limiting. In addition to the illustrative aspects, embodiments, and features described above, further aspects, embodiments, and features will become apparent by reference to the following drawings and the detailed description.

BRIEF DESCRIPTION OF THE DRAWINGS

A clear conception of the advantages and features constituting the present disclosure, and of the construction and operation of typical mechanisms provided with the present disclosure, will become more readily apparent by referring to the exemplary, and therefore non-limiting, embodiments illustrated in the drawings accompanying and forming a part of this specification, wherein like reference numerals designate the same elements in the several views, and in which.

Figure 1:
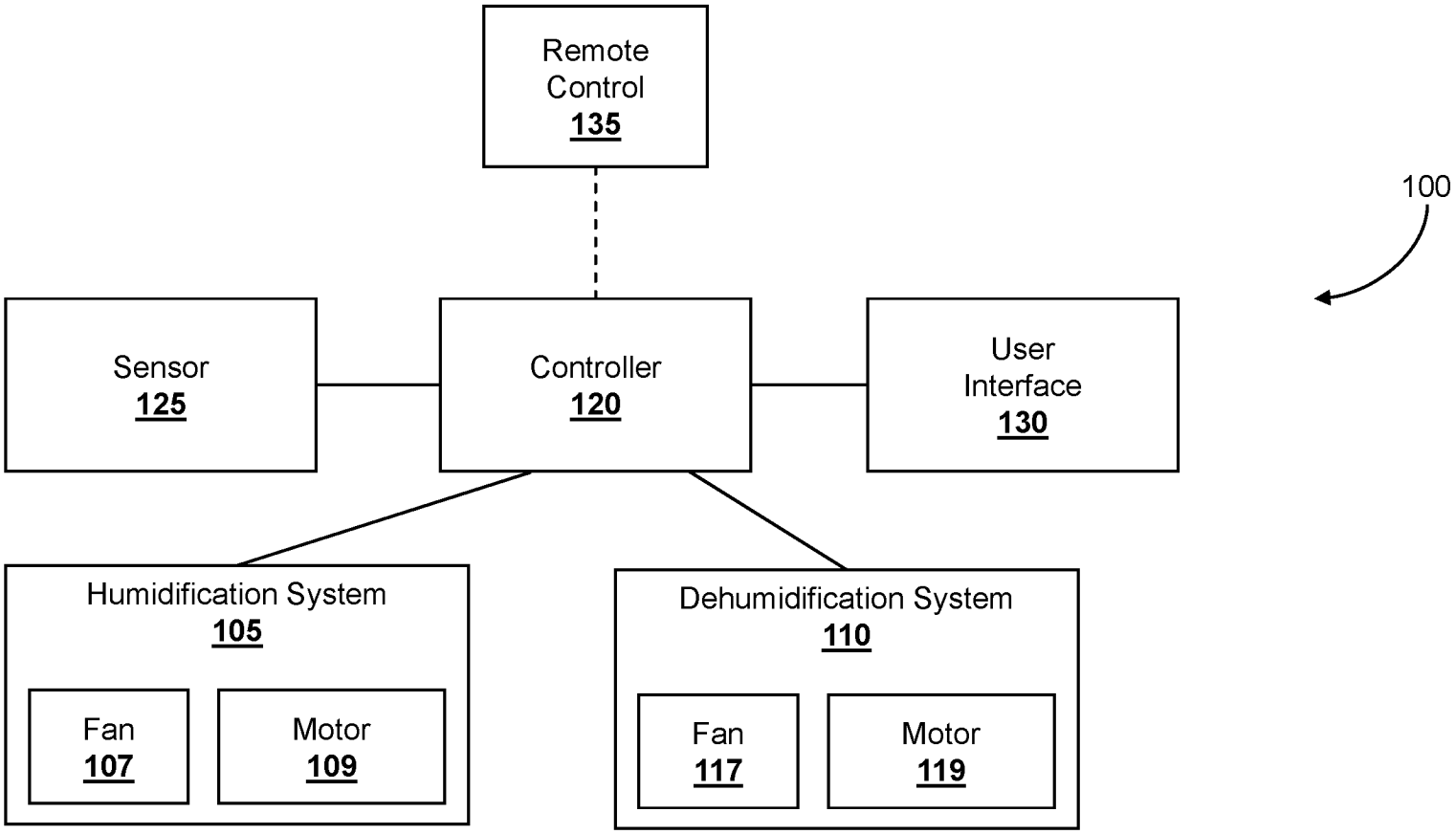
FIG. 1 is a block diagram illustrating a humidity control system, according to an example embodiment.

The foregoing and other features of the present disclosure will become apparent from the following description and appended claims, taken in conjunction with the accompanying drawings. Understanding that these drawings depict only several embodiments in accordance with the disclosure and are therefore, not to be considered limiting of its scope, the disclosure will be described with additional specificity and detail through use of the accompanying drawings.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

Referring generally to the figures, a humidity control system for selectively increasing and/or decreasing moisture in ambient air is shown. Traditional heating, ventilation, and/or air conditioning (HVAC) systems that combine humidifying systems with dehumidifying systems generally utilize multiple distinct humidity setpoints for separate control of the humidifying system and the dehumidifying system. These different humidity setpoints must have a sufficient difference in humidity level to prevent the humidifying and dehumidifying systems for fighting against each other, essentially amounting to non-stop operation of at least one of the humidifying or dehumidifying systems. For example, such a traditional system may have a humidification setpoint of 50% relative humidity (RH) and a dehumidification setpoint of 55% RH. In this way, a humidification call is initiated when the sensed relative humidity of the associated space falls below 50% and a dehumidification call is initiated when the sensed relative humidity exceeds 55%. However, due to this difference in setpoints, such combined systems offer imprecise humidity control and a more complicated control interface that requires the setting of multiple humidity setpoints. Describe herein is an improved humidity control system that allows for coordinated control of a humidifying system and a dehumidifying system based on a single setpoint humidity level. Such a system provides more precise control of humidity within the system as well as simplified user control.

According to an embodiment of this system, a humidity control system implements lockout condition by which activation of an opposing humidification or dehumidification system is prevented for a fixed period of time after a call humidification or dehumidification call is made to the other of the humidification or dehumidification system. Implementation of the lockout condition prevents the two systems from continually working against each other with opposing humidification and dehumidification calls. The humidity control system may further include an override capability by which the opposing humidification or dehumidification system may override the lockout condition in response to an override condition. For example, if a humidity level within a monitored space changes by a threshold amount during a lockout period, the humidity control system may terminate the lockout condition and allow the opposing humidification or dehumidification system to be activated regardless of how much time remains for the lockout period. In another example, the lockout condition may be terminated prematurely in accordance with a time-based schedule. For example, if a time-based schedule for controlling humidity within the space is implemented, the humidity control system may recognize that an upcoming time period of the time-based schedule may call for a changed humidity setpoint. The humidity control system may terminate the lockout condition prematurely to begin changing the humidity level toward the humidity setpoint called for in the upcoming time period.

Referring to FIG. 1, a schematic representation of a humidity control system 100 is shown, according to an exemplary embodiment. The humidity control system 100 may be integrated as an HVAC system or a component of an HVAC system and may be configured to control humidity of air within an indoor (or mostly indoor) space including, for example, within a home, a business, a hotel, a greenroom, a greenhouse, a grow room, or any other building or structure for which it may be desirable to control the humidity and/or other conditions of ambient air. The humidity control system 100 includes a humidification system 105 configured to increase the humidity of air within an indoor space and a dehumidification system 110 configured to decrease the humidity of air within the indoor space. The humidification system 105 may include an in-line humidifier connected to the ductwork of an HVAC system, a portable humidifier, or any other component suitable for increasing the humidity levels within the indoor space. The dehumidification system 110 may include an in-line dehumidifier connected to the ductwork of an HVAC system, a portable dehumidifier, or any other component suitable for decreasing the humidity levels within the indoor space. In an embodiment, the humidification system 105 and the dehumidification system 110 may have respective fans 107, 117 for circulating air and respective motors 109, 119 for driving the fans and/or other components of the respective systems. In alternative embodiments, motors and/or fans of an HVAC system may be used to circulate humidified or dehumidified air throughout the indoor space.

The humidification system 105 and dehumidification system 110 are each operatively coupled to a controller 120, which may be configured to control operations of each of the humidification system 105 and dehumidification system 110. In various embodiments, the controller 120 may be a non-transitory computer-readable medium or processor, having computer-readable instructions stored thereon that, when executed, cause the controller 120 to carry out operations called for by the instructions. In various embodiments, the controller 120 may be a thermostat, humidistat, or other control device. In yet other embodiments, the controller 120 may be configured as part of a data cloud configured to receive commands from a user control device and/or a remote computing device. The controller 120 may be configured to controller operation and change operational states of the humidification system 105 and dehumidification system 110 to control the humidity levels within a structure.

The controller 120 may be operably connected to one or more sensors 125, which may be configured to detect one or more ambient conditions within a space. In various embodiments, the one or more sensors 125 may including sensors configured to detect a humidity level, a temperature, a dew point, a leaf temperature (e.g., in an agricultural setting), a lighting status (e.g., on/off, degree of illumination, etc.), or other relevant characteristics of the space for purposes of controlling humidity. The controller 120 may be configured to receive one or more signals from the one or more sensors 125 such that the controller 120 may control (i.e., changing an operation or operational state of) at least one of the humidification system 105 and the dehumidification system 110 based on the one or more signals received from the one or more sensors 125. The controller 120 may also be operably connected to a user interface 130 (e.g., graphical user interface, one or more buttons, one or more dials, etc.), which may be configured to receive commands from a user related to operation of the humidity control system 100. In various embodiments, the controller 120 may be configured to receive one or more signals from the user interface 130. The controller 120 may be communicatively coupled to one or more remote control devices 135 (e.g., thermostat, humidistat, portable user device, cloud-based computing device, server, etc.), which may be configured to send one or more signals to the controller 120. In various embodiments, controller 120 may be configured to control the humidification system 105 and dehumidification system 110 in the manner described below with reference to FIGS. 2 and 3.

Figure 2:
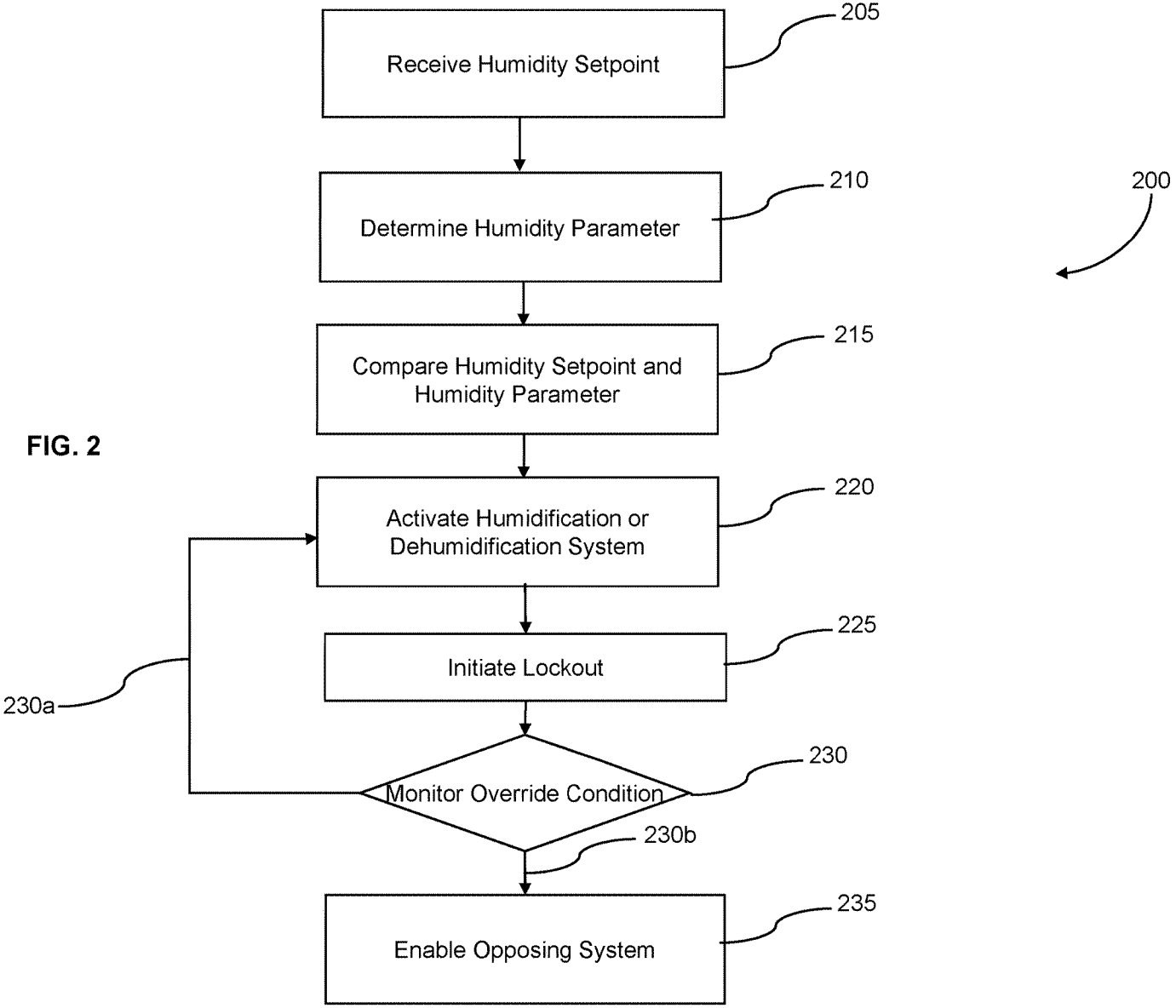
FIG. 2 is a flow diagram illustrating operations for controlling humidity within a space performed by a humidity control system 100, according to an example embodiment.

FIG. 2 shows a flow diagram illustrating a method 200 for controlling humidity within a space performed by humidity control system 100, according to an exemplary embodiment. In an operation 205, the controller 120 of humidity control system 100 receives a humidity setpoint input that is indicative of a desired humidity level within a space. The humidity setpoint may be received from a user via a user interface of the controller 120, from a user via remote control device 135 (e.g., via a remotely located thermostat, humidistat, smartphone, cloud-based computing device, etc.), or in accordance with a time-based schedule set by a user or other entity via the controller 120 or remote control device 135.

In an operation 210, controller 120 determines a humidity parameter associated with the space. In an embodiment, the humidity parameter may be a humidity level (e.g., a relative humidity) of the space. According to such an embodiment, controller 120 receives a humidity measurement directly from sensor(s) 125 (e.g., from a humidity sensor). Sensor(s) 125 may be separate from or incorporated within controller 120. In other embodiments, controller 120 may calculate the humidity level based on information received from sensor(s) 125. For example, controller 120 may calculate humidity based on one or more of a temperature, a water vapor amount, a leaf temperature, a lighting condition, etc. In an embodiment, the leaf temperature (e.g., the temperature at or of a leaf of a plant) may be obtained using thermal imaging or thermal coupling. The humidity level determined by controller 120 may be a relative humidity in certain implementations. According to such an embodiment, the relative humidity may be determined based on a humidity measurement of the space and an ambient temperature of the space or a leaf temperature.

In other implementations, the humidity parameter determined by controller 120 may be a vapor pressure deficit. Vapor pressure deficit measures a difference in pressure between water content in air and a saturation point of the air (i.e., the maximum amount of water content air can carry at its current temperature). Vapor pressure deficit may be determined by subtracting a pressure of vapor in the air form the vapor pressure which would be found in saturated air at a given temperature. Controller 120 may calculate the vapor pressure deficit based on a received measurement of the humidity level within the space and a received measurement of the ambient temperature of the space as known to those of skill in the art.

Controller 120 compares the humidity setpoint and the determined humidity parameter in an operation 215. In the event that the controller 120 determines that a determined humidity level is below the humidity setpoint, the controller 120 generates a humidification call to the humidification system 105 requesting humidification of the space. In the event that the controller 120 determines that the determined humidity level is greater than the humidity setpoint, the controller 120 generates a dehumidification call to the dehumidification system 110 requesting dehumidification of the space. Alternatively, where vapor pressure deficit is used for control purposes, controller 120 may compare the calculated vapor pressure deficit to a threshold value and active the humidification and/or dehumidification system accordingly.

In an operation 220, the controller 120 activates the humidification system 105 by communicating the humidification call to the humidification system 105 (in the event that the determined humidity level is below the humidity setpoint) or activates the dehumidification system 110 by communicating the dehumidification call to the dehumidification system 110 (in the event that the determined humidity exceeds the humidity setpoint). Upon receiving a call for humidification, the humidification system 105 begins humidification operations which may include turning on the fan 107 and sending humidified air to the space. Upon receiving a call for dehumidification, the dehumidification system 110 begins dehumidification operations which may include turning on fan 117 and sending dehumidified air to the space.

In an operation 225, the controller 120 initiates a lockout condition for the other of the humidification system 105 or the dehumidification system 110 for a fixed period of time (e.g., a lockout period). In an embodiment, the lockout condition is initiated at an end of the preceding humidification or dehumidification call (e.g., the call for humidification of dehumidification associated with operation 220). For example, the lockout condition is initiated after the humidification or dehumidification need associated with the corresponding call in operation 220 is met and the corresponding call ends.

During the period of time associated with the lockout condition, the other of the humidification system 105 or the dehumidification system 110 (i.e., the system that was not activated in operation 220) is locked out such that the system may not be activated. In an embodiment, the lockout condition may be initiated upon activation of one of the humidification or dehumidification systems or in response to another trigger associated with a call for humidification or dehumidification.

The duration of the lockout period may be a predetermined fixed period of time in some implementations. In other implementations, the duration of the lockout period may be dynamically changed. For example, the lockout period may be adjusted based on room size, overall indoor space size, air quality conditions (e.g., humidity, temperature, length of time it takes the system to satisfy a humidity setting as determined using in-home sensors, etc.). In once such implementation, a user may input a home or room size (or other lockout period-relevant parameter) into controller 120, and the controller may adjust the lockout period based on settings stored in a look-up table or other manner of associating house or room size (or other parameter) to lockout period duration. In still other implementations, controller 120 may utilize a machine-learning model or other artificial intelligence to adjust the lockout period based on sensed air quality parameters within the building and/or response of HVAC equipment to user settings and associated effect on the sensed air quality parameters.

In still other implementations, the lockout period may further be influenced by event-based triggers that to change the duration of the lockout period. For example, the system may include one or more sensors within the home of sensing events, including door sensors, motion sensors, water flow sensors, etc, that are communicatively coupled to controller 120. Upon the triggering of one or more of these sensors, the controller 120 may adjust a lockout period duration. For example, upon a door sensor indicating that a door is open, the lockout period may be lengthened to avoid (or reduce) operation of HVAC equipment while the door is open. Similarly for another example, upon sensing that a temperature or humidification setting has reached a desired threshold or a water flow sensor indicating that water is being introduced to plants, the lockout period may be shortened.

In still further embodiments, the system may utilize variable humidification and dehumidification outputs and adjust the lockout period accordingly to accommodate such variable outputs and real-time air quality parameters within the indoor space. The utilization of variable humidification/dehumidification may be based on a difference between a user-defined humidification setpoint (or other setpoint) and an associated measured humidity value within the space (or other relevant air quality parameter), such that the total humidification/dehumidification output may be tailored based on the difference. The humidification/dehumidification output may be lowered as the difference between the setpoint and measured value decreases, thereby reducing the likely overshoot. Because the overshoot is reduced, the lockout period may also be dynamically adjusted to shorten its duration in view of the lower likely overshoot.

During the lockout period, the controller 120 monitors conditions associated with the space to determine an existence of an override condition in an operation 230. An override condition may be any condition that requires termination of the lockout condition. In an embodiment, an override condition may be determined in response to a difference between a determined humidity level of the space and the humidity setpoint exceeding a threshold difference amount. For example, controller 120 may continually monitor humidity levels of the space during the lockout period in the manner described in operations 210 and 215 and thereby determine updated humidity levels. Additionally, controller 120 may compare the updated determined humidity levels to the humidity setpoint and determine a difference between the updated determined humidity levels and the humidity setpoint. Controller 120 further compares this difference to an override threshold difference (e.g., a difference amount that is indicative of an override condition). For example, the override threshold difference may be predetermined at 5% relative humidity (RH) such that when the humidity level of the indoor space has a greater than 5% RH difference from the humidity setpoint, an override condition exists. According to such an example, for a humidity setpoint of 55% RH, an override condition will exist when the humidity level of the space falls below 50% RH or exceeds 60% RH. In further embodiments, the override threshold different may be variable such that it is selectable by a user or installer.

In another embodiment, an override condition may be determined based on an illumination status (e.g., lights on, lights off, degree of illumination, etc.) associated with the space. Such an embodiment may be particularly useful for humidity control systems utilized in agricultural settings such as greenhouses, grow rooms, etc. For example, sensor (s) 125 may include a light sensor that may communicate an illumination status to the controller 120. Controller 120 may determine the existence of an override condition in response to receiving an indication of a particular illumination status, thereby allowing the opposing humidification or dehumidification system 105, 110 to be activated even in the absence of the override threshold humidity difference condition from the preceding paragraph being met.

Still further, an override condition may be determined based on a time-based humidity control schedule. For example, controller 120 may enable the utilization of a time-based schedule for controlling the humidity setpoint for the space. As such, a user (or other entity or individual) may create a schedule by which the humidity setpoint may be set. In this manner, the humidity setpoint may be changed and controlled based on one or more of a time of day, day of week, weekend, weekday, holiday, etc. Such a schedule may have two or more time periods with each time period having a respective associated humidity setpoint (and optionally additional HVAC settings). The time periods may be preset or variable and may be associated with any manner of segregating time, e.g., by hour, day, week, subset of hours (e.g., 7-10 am, 10 am-5 pm, 5 pm-7 am, etc.) as known to those of skill in the art. Each time period may have a set start time and a set end time such that upon termination of a first time period a next time period begins. The set end time may be predetermined or based on the set start time or a next set start time. According to such an implementation, an override condition may be determined based on changes to the humidity setpoint associated with upcoming time periods.

Figure 3:
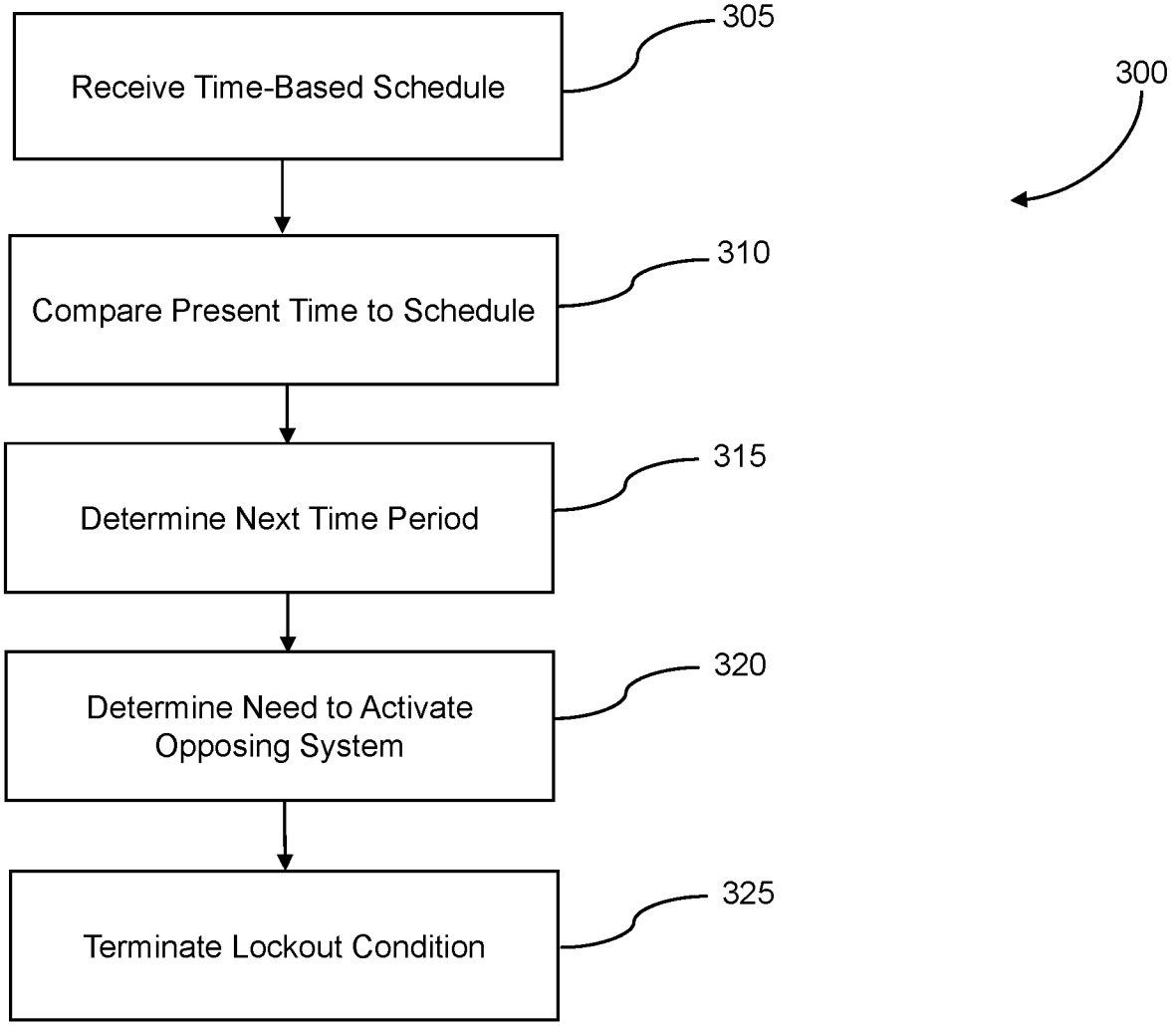
FIG. 3 is a flow diagram illustrating operations performed by a humidity control system, according to an example embodiment.

FIG. 3 is a flow diagram 300 illustrating operations performed by a humidity control system 100 for determining an override condition based on a time-based schedule, according to an example embodiment. In an operation 305, a time-based schedule for controlling a humidity setpoint is received by controller 120. The time-based schedule may be input by a user directly via a user interface provided on controller 120 or received from a remote control device 135.

In an operation 310, controller 120 compares a present time to the time-based schedule. Controller 120 may obtain the present time by accessing a local clock of the controller or may obtain the present time from a remote device such a networked server or service that provides a time of day (and optionally date, etc.) remotely.

In an operation 315, controller 120 determines a next time period subsequent to the present time. Determining the next time period may further include determining a current time period for the present time and determining a next time period that immediately follows the current time period as defined in the time-based schedule. Determining the next time period may further include determining an amount of time until the next time period begins and determining a humidity setpoint (and/or other HVAC settings) associated with the next time period.

In an operation 320, controller 120 determines that the opposing humidification or dehumidification system should be activated based on a comparison of a current humidity level of the space to a humidity setpoint associated with the next time period. Such a determination may optionally factor in one or more of a difference between the current humidity level of the space and the humidity setpoint associated with the next time period and an amount of time between the present time and a start of the next time period of the time-based schedule. For example, controller 120 may determine that the opposing humidification or dehumidification system should be activated in response to a determination both that the amount of time between the present time and the start of the next time period is less than a fixed time difference threshold and that the difference between the currently humidity level of the space and the humidity setpoint associated with the next time period is greater than a fixed humidity difference threshold. In this way, controller 120 allows the humidity control system to begin modifying the humidity level of the indoor space to accommodate a humidity setting associated with a next time period prior to the start of that next time period.

Still further, activation of a humidification or dehumidification system may be prevented in accordance with a time-based schedule. For example, controller 120 may determine that the amount of time between the present time and the start of the next time period is less than a fixed time difference threshold and that the difference between the currently humidity level of the space and the humidity setpoint associated with the next time period is greater than a fixed humidity difference threshold. The controller 120 may further determine that the current humidity level is less than the current humidity setpoint, which would typically cause activation of the humidification system. However, activation of the humidification system is prevented due the sufficiently lower humidity setpoint (i.e., lower than the humidity difference threshold) associated with the next time period of the time-based schedule, which begins in an amount of time less than the time difference threshold.

In other embodiments, a control algorithm for the humidity control system may have additional graduated levels of operation. For example, the system may utilize one or more additional fixed time difference thresholds associated with one or more additional respective fixed humidity difference thresholds. For larger fixed time difference thresholds, large fixed humidity difference thresholds may be needed to cause activation of the opposing humidification system or dehumidification system and vice versa. Thus, as one example, the control algorithm may have three graduated steps for causing activation of the opposing system: 1) a time difference threshold of 30 minutes and a humidity difference threshold of 10% RH; 2) a time difference threshold of 20 minutes and a humidity difference threshold of 7% RH; and 3) a time difference threshold of 10 minutes and a humidity difference threshold of 5% RH. In other embodiments, fewer or greater numbers of steps and different associated threshold amounts may be used.

Upon determining that the opposing humidification or dehumidification system should be activated as discussed above for operation 320, controller 120 may terminate the lockout condition 325 and allow for the opposing system to be activated.

Referring back to FIG. 2, as depicted in branch 230*a*, upon determination of an override condition, the controller 120 causes activation of an appropriate one of the humidification system 105 or the dehumidification system 110 to address the particular override condition. In the event that the lockout period expires without encountering an override condition as depicted in branch 230*b*, the opposing humidification system 105 or dehumidification system 110 is enabled in operation 235 such that the opposing system may be activated in response to a corresponding humidification or dehumidification call without requiring existence of an override condition.

Below are described several example use embodiments of the concepts described throughout this disclosure.

Example 1

In a first example embodiment, a humidity setpoint is defined at 50% RH. Upon determination by the controller that the current humidity level of an associated indoor space is 51% RH, the dehumidification system turns on. As the dehumidification system operates, the controller eventually determines that the humidity level of the indoor space has dropped to 49% RH in response to which the dehumidification system is turned off. Using traditional control technologies, the humidification system would typically turn on at this point because the determined humidity level of the space has dropped below the 50% RH humidity setpoint. However, the system described herein instead implements a lockout condition that prevents activation of the humidification system for a period of 15 minutes after the end of the prior dehumidification call. After 15 minutes has passed, if the determined humidity level of the space still below the 50% RH humidity setpoint, the humidification system would be activated. If at any time within the 15 minute period of the lockout, the determined humidity level exceeded the humidity setpoint (e.g., increased above 50% RH), the dehumidification system would be activated and the lockout condition for the humidification system would be restarted.

Example 2

In a second example embodiment, a humidity setpoint is defined at 50% RH. Upon determination by the controller that the current humidity level of an associated indoor space is 51% RH, the dehumidification system turns on. As the dehumidification system operates, the controller eventually determines that the humidity level of the indoor space has dropped to 49% RH in response to which the dehumidification system is turned off. Due to implementation of a lockout condition as discussed in Example 1, the humidification is locked out and is not activated in response to the determined humidity level initially dropping below the humidity setpoint. The controller continues to monitor the humidity level of the space during the lockout period and eventually determines that the humidity level has dropped to 40% RH. The system includes a lockout override humidity threshold difference of 10% RH. Accordingly, upon determining that this threshold difference trigger has been satisfied (in response to the determined humidity level falling 10% RH below the humidity setpoint), the controller prematurely terminates the lockout condition prior to the expiration of the 15 minute lockout period and allows the humidification system to be activated. After the humidification system has increased the humidity level of the space to satisfy the 50% RH humidity setpoint, the humidification system is deactivated and a lockout condition is implemented by which the dehumidification system is locked out for the 15 minute lockout period.

Example 3

In a third example embodiment, the controller utilizes a time-based schedule for controlling humidity levels of an indoor space. The time-based schedule implements a first humidity setpoint of 50% RH for a first time period associated with a 10:00 μm to 6:00 am time period and a second humidity setpoint of 40% RH for a second time period associated with a 6:00 am to 10:00 pm time period. During the first time period, the controller determines that the current humidity level of the space is 49% RH and causes activation of the humidification system. The humidification system operates bringing the humidity level to 50% RH at 5:40 am, upon which a lockout condition for the dehumidification system is implemented. The controller continues to monitor the humidity level of the space and the difference between a current time and the start of the second time period. The system includes a schedule-based override based on a time difference threshold of 10 minutes. Accordingly, upon determining at 5:50 am that the difference between a current time and the start of the second time period is 10 minutes and that the currently humidity level of the space is above the humidity setpoint of 40% RH associated with the second time period, the controller prematurely terminates the lockout condition prior to the expiration of the lockout period and allows the dehumidification system to be activated. After the dehumidification system has decreased the humidity level of the space to satisfy the 40% RH humidity setpoint associated with the second time period, the dehumidification system is deactivated and a lockout condition is implemented by which the humidification system is locked out for the 15 minute lockout period.

Example 4

In a fourth example embodiment, the controller utilizes a time-based schedule for controlling humidity levels of an indoor space. The time-based schedule implements a first humidity setpoint of 50% RH for a first time period associated with a 10:00 μm to 6:00 am time period and a second humidity setpoint of 40% RH for a second time period associated with a 6:00 am to 10:00 pm time period. The system includes a schedule-based override based on a time difference threshold of 10 minutes and a humidity difference threshold of 5% RH. At 5:52 am, the controller determines that the current humidity level of the space has dropped to 49% RH. Typically, the humidification system would be activated to increase the humidity level to satisfy the 50% RH setpoint. However, due to the schedule-based override, the controller determines that the current time is within the time-difference threshold of 10 minutes from the start of the second time period (at 6:00 am) and determines that the difference between current determined humidity level and the humidity setpoint for the second time period is greater than the humidity difference threshold of 5% RH. In response, the controller prevents the humidification system from being activated.

Notwithstanding the embodiments described above in FIGS. 1-3, various modifications and inclusions to those embodiments are contemplated and considered within the scope of the present disclosure.

It is also to be understood that the construction and arrangement of the elements of the systems and methods as shown in the representative embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed.

Accordingly, all such modifications are intended to be included within the scope of the present disclosure. Any means-plus-function clause is intended to cover the structures described herein as performing the recited function and not only structural equivalents but also equivalent structures. Other substitutions, modifications, changes, and omissions may be made in the design, operating conditions, and arrangement of the preferred and other illustrative embodiments without departing from scope of the present disclosure or from the scope of the appended claims.

Furthermore, functions and procedures described above may be performed by specialized equipment designed to perform the particular functions and procedures. The functions may also be performed by general-use equipment that executes commands related to the functions and procedures, or each function and procedure may be performed by a different piece of equipment with one piece of equipment serving as control or with a separate control device.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Similarly, unless otherwise specified, the phrase "based on" should not be construed in a limiting manner and thus should be understood as "based at least in part on." Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances, where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "substantially," etc., mean plus or minus ten percent Moreover, although the figures show a specific order of method operations, the order of the operations may differ from what is depicted. Also, two or more operations may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection operations, processing operations, comparison operations, and decision operations.

The operations described in this specification can be implemented as operations performed by a data processing apparatus on data stored on one or more computer-readable storage devices or received from other sources. The term "data processing apparatus" or "computing device" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, embodiments of the subject matter described in this specification can be implemented on a computer having a display device, e.g., a CRT (cathode ray tube) or LCD (liquid crystal display) monitor, for displaying information to the user and a keyboard and an I/O device, e.g., a mouse or a touch sensitive screen, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Embodiments of the subject matter described in this specification can be implemented in a computing system that includes a back-end component, e.g., as a data server, or that includes a middleware component, e.g., an application server, or that includes a front-end component, e.g., a client computer having a graphical user interface or a web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some embodiments, a server transmits data (e.g., an HTJVIL page) to a client device (e.g., for purposes of displaying data to and receiving user input from a user interacting with the client device). Data generated at the client device (e.g., a result of the user interaction) can be received from the client device at the server.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. In some cases, the actions recited herein can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A system for controlling a humidity level of an indoor space, the system comprising:

a humidification system configured to increase the humidity level of the indoor space;

a dehumidification system configured to decrease the humidity level of the indoor space;

a sensor configured to sense ambient conditions of the indoor space; and a controller operably coupled to the humidification system, the dehumidification system, and the sensor, wherein the controller is configured to:

receive a humidity setpoint for the indoor space;

determine a humidity parameter associated with the indoor space;

compare the determined humidity parameter to the humidity setpoint;

in response to a result of the comparing, cause activation of one of a humidification system or a dehumidification system with a humidification call or a dehumidification call;

in response to expiration of the humidification call or the dehumidification call associated with the activation of the one of the humidification system or the dehumidification system, initiate a lockout condition during which only the other of the one of the humidification system or the dehumidification system is prevented from being activated;

monitor conditions associated with the indoor space to determine existence of an override condition; and in response to at least one of the override condition or expiration of the lockout condition, enable activation of the other of the one of the humidification system or the dehumidification system.

2. The system of claim 1, wherein the humidity parameter comprises a measured or calculated humidity level.

3. The system of claim 1, wherein the lockout condition comprises a predetermined period of time during which the other of the one of the humidification system or the dehumidification system is prevented from being activated.

4. The system of claim 1, wherein the humidity parameter comprises a sensed humidity level, wherein to monitor the conditions associated with the indoor space to determine existence of the override condition, the controller is configured to:

determine a difference between the sensed humidity level and the humidity setpoint; and determine the existence of the override condition in response to the difference between the sensed humidity level and the humidity setpoint exceeding an override threshold difference.

5. The system of claim 4, wherein the controller is further configured to, in response to determining the existence of the override condition, cause activation of the other of the one of the humidification system or the dehumidification system.

6. The system of claim 1, wherein the controller is further configured to:

receive a sensed humidity level associated with the indoor space; and receive a sensed temperature associated with the indoor space;

wherein, to determine the humidity parameter associated with the indoor space, the controller is further configured to calculate a vapor pressure deficit associated with the indoor space based on the sensed humidity level and the sensed temperature.

7. The system of claim 1, wherein, to monitor the conditions associated with the indoor space to determine existence of the override condition, the controller is further configured to implement a schedule-based override condition.

8. The system of claim 7, wherein implementing the schedule-based override condition comprises:

comparing a present time to a time-based schedule, wherein the time-based schedule comprises a plurality of time periods having respective associated humidity setpoints;

determining a next time period of the time-based schedule based on the present time;

determining that the humidity setpoint associated with the next time period necessitates activation of the other of the one of the humidification system or the dehumidification system; and in response to the present time being within a threshold time of the next time period and in response to the determination that the humidity setpoint associated with the next time period necessitates activation of the other of the one of the humidification system or the dehumidification system, causing activation of the other of the one of the humidification system or the dehumidification system prior to the expiration of the lockout condition.

9. The system of claim 8, wherein determining that the humidity setpoint associated with the next time period necessitates activation of the other of the one of the humidification system or the dehumidification system comprises:

monitoring the humidity parameter associated with the indoor space during the lockout condition;

determining a difference between the monitored humidity parameter and the humidity setpoint associated with the next time period; and determining that the humidity setpoint associated with the next time period necessitates activation of the other of the one of the humidification system or the dehumidification system in response to the difference between the monitored humidity parameter and the humidity setpoint associated with the next time period satisfying a threshold difference.

10. The system of claim 1, wherein the humidification system or the dehumidification system includes a fan configured to circulate air and a motor configured to drive the fan.

11. The system of claim 1, wherein the humidification system is a humidifier and the dehumidification system is a dehumidifier.

12. A method for controlling a humidity level of an indoor space, the method comprising:

receiving, by a controller, a humidity setpoint for the indoor space;

determining, by the controller, a humidity parameter associated with the indoor space;

comparing, by the controller, the determined humidity parameter to the humidity setpoint;

in response to a result of the comparing, causing, by the controller, activation of one of a humidification system or a dehumidification system with a humidification call or a dehumidification call;

in response to expiration of the humidification call or the dehumidification call associated with the activation of the one of the humidification system or the dehumidification system, initiating, by the controller, a lockout condition during which only the other of the one of the humidification system or the dehumidification system is prevented from being activated;

monitoring, by the controller, conditions associated with the indoor space to determine existence of an override condition; and in response to at least one of the override condition or expiration of the lockout condition, enabling, by the controller, activation of the other of the one of the humidification system or the dehumidification system.

13. The method of claim 12, wherein the humidity parameter comprises a humidity level, and wherein causing activation of one of the humidification system or the dehumidification system comprises causing activation of the humidification system in response to the determined humidity level dropping below the humidity setpoint.

14. The method of claim 12, wherein the humidity parameter comprises a humidity level, and wherein causing activation of one of the humidification system or the dehumidification system comprises causing activation of the dehumidification system in response to the determined humidity level exceeding the humidity setpoint.

15. The method of claim 12, wherein the lockout condition comprises a predetermined period of time during which the other of the one of the humidification system or the dehumidification system is prevented from being activated.

16. The method of claim 12, wherein monitoring the conditions associated with the indoor space to determine existence of the override condition comprises:

determining a difference between the determined humidity parameter and the humidity setpoint; and determining the existence of the override condition in response to the difference between the determined humidity parameter and the humidity setpoint exceeding an override threshold difference.

17. The method of claim 16, further comprising, in response to determining the existence of the override condition, causing activation of the other of the one of the humidification system or the dehumidification system.

18. The method of claim 12, wherein determining the humidity parameter associated with the indoor space comprises receiving a sensed humidity level from a humidity sensor.

19. The method of claim 12, further comprising:

receiving a sensed humidity level associated with the indoor space; and receiving a sensed temperature associated with the indoor space;

wherein determining the humidity parameter associated with the indoor space comprises calculating a vapor pressure deficit associated with the indoor space based on the sensed humidity level and the sensed temperature, wherein the determined humidity parameter comprises the calculated vapor pressure deficit, and wherein the humidity setpoint comprises a threshold vapor pressure deficit.

20. The method of claim 12, wherein monitoring the conditions associated with the indoor space to determine existence of the override condition comprises implementing a schedule-based override condition.

21. The method of claim 20, wherein implementing the schedule-based override condition comprises:

comparing a present time to a time-based schedule, wherein the time-based schedule comprises a plurality of time periods having respective associated humidity setpoints;

determining a next time period of the time-based schedule based on the present time;

determining that the humidity setpoint associated with the next time period necessitates activation of the other of the one of the humidification system or the dehumidification system; and in response to the present time being within a threshold time of the next time period and in response to the determination that the humidity setpoint associated with the next time period necessitates activation of the other of the one of the humidification system or the dehumidification system, causing activation of the other of the one of the humidification system or the dehumidification system prior to the expiration of the lockout condition.

22. The method of claim 21, wherein determining that the humidity setpoint associated with the next time period necessitates activation of the other of the one of the humidification system or the dehumidification system comprises:

monitoring the humidity parameter associated with the indoor space during the lockout condition;

determining a difference between the monitored humidity parameter and the humidity setpoint associated with the next time period; and determining that the humidity setpoint associated with the next time period necessitates activation of the other of the one of the humidification system or the dehumidification system in response to the difference between the monitored humidity parameter and the humidity setpoint associated with the next time period satisfying a threshold difference.

23. The method of claim 12, further comprising determining the existence of the override condition in response to a lights on or lights off status determination associated with the indoor space.

24. The method of claim 12, further comprising adjusting a length of the lockout condition based on sensed trigger events.

25. The method of claim 12, further comprising adjusting a length of the lockout condition in response to a user-defined input regarding a parameter associated with the indoor space.

* * * * *